United States Patent [19]

Watts

[11] 4,158,365

[45] Jun. 19, 1979

[54] TANK CLEANING APPARATUS

[76] Inventor: Grady Watts, 50 Sintsink Dr. East, Port Washington, N.Y. 11050

[21] Appl. No.: 893,701

[22] Filed: Apr. 5, 1978

[51] Int. Cl.[2] ..... B08B 3/02; B08B 9/08

[52] U.S. Cl. ..... 134/113; 134/168 R

[58] Field of Search ..... 239/102; 134/113, 168 R, 134/184

[56] References Cited

U.S. PATENT DOCUMENTS

| | | | |
|---|---|---|---|
| 3,022,792 | 2/1962 | Perkins | 134/168 R |
| 3,134,070 | 5/1964 | Meyer | 134/113 |
| 3,236,248 | 2/1966 | Ray | 134/168 R X |
| 3,460,988 | 8/1969 | Kennedy, Jr. et al. | 239/102 X |

*Primary Examiner*—Robert L. Bleutge

*Attorney, Agent, or Firm*—George B. Oujevolk

[57] ABSTRACT

An apparatus for cleaning tanks comprising in combination a rectangular box like frame having front, rear and longitudinal sides defined therein; a plurality of inlet ports at the rear coded for a particular liquid, a plurality of outlet ports similarly coded and similarly aligned at the rear, valves at each of the inlet and outlet ports; a first trunk line connected and fed by all of the valves, a pump fed by said first trunk line; an output line fed by the pump, a sonic or ultrasonic spray nozzle assembly at the end of the output line that is insertable into a tank to be cleaned, a return port in the frame for receiving materials from the cleaned tank, a return pump connected to the return port and a return trunk line fed by the return pump; and, a plurality of return lines connected to the outlet ports with a valve for each line, the valves all connecting to the return trunk line, the return lines feeding waste liquids from the return trunk lines to the outlet ports.

4 Claims, 7 Drawing Figures

TANK CLEANING APPARATUS

BACKGROUND OF THE INVENTION

The present invention relates to the cleaning of enclosed vessels or tanks and, more particularly, to cleaning of tanks containing free iron molecules, such as stainless steel tanks.

BRIEF DESCRIPTION OF THE PROBLEMS PRESENTED

Among the problems in tank trailer operations are cleaning out cargo residues, and disposal of the cleaning wastes.

For most fleets, it is just economically impossible to keep tank trailers hauling the same product all the time. With effective cleaning, tankers can carry many different products, with seasonal changes, and gain the benefits of backhauls where possible. But devising those cleaning procedures and materials, and disposing of the cleaning wastes, has been an ever-growing problem.

There are about 500 distinct products hauled. Some of these are water-soluble, some are not; some are almost indestructable when they harden. The worst products for hauling are the isocyanates such as TDI, MDI, etc. In the presence of water, they form urea - and urea is insoluble. Other products posing difficult cleaning and waste disposal problems are varnishes, lacquers, liquid plastics, carbon black, indigo blue, model-maker's glue, printer's ink, and latex.

Linked to the cleaning job is the problem of disposal of cleaning wastes. When a chemical solvent is used, it is usually recovered as it drains from the trailer for reuse. Eventually, such solvents become saturated and must be disposed of. Often, disposal has been by hauling them to a dump, pouring them on a convenient piece of unused ground, or by burning. Air pollution laws and public nuisance complaints have largely closed the door to these methods.

Perhaps the greatest cleaning solution problem has been the disposal of water or water/detergent solutions used for washing trailers inside. These are used in large volumes, and increasingly tough water pollution laws no longer permit dumping them "as is" into a convenient stream or into the town sewage system. What is needed is a system requiring extremely small amounts of liquids to achieve the cleaning results; no more than five gallons. The average usage should be no more than three gallons. The magnitude of the waste-water problem is little understood even by many persons skilled in the art. At least ten percent of the total cleaning costs are often devoted to water treatment and disposal problems. The problem varies in different areas depending on whether the effluent goes to a public sewage plant or into a stream.

Another problem is a phenomenon termed "passivation". Free iron molecules is another phenomenon little understood. The removal of such free iron molecules is termed passivation. The trouble with such free iron molecules is that they rust and contaminate or discolor liquids contained in the tank, e.g., scotch whiskey and milk. Tanks which have stainless steel interiors often have a tendency of either attracting or producing free iron molecules. One way to treat such a tank is to use an acid cleaning spray. The acid will attack the free iron molecules and form a salt solution in the acid which can then be washed out. The trouble with this process is that the acid cannot remain long in the tank since the acid then attacks the stainless steel. Thus, a detergent wash must be rapidly applied throughout the interior of the tank to remove the acid. This then requires that a plurality of liquids be applied in rapid succession to the interior of the tank. Certain types of these liquids can be recycled while other liquids have to be discarded in safe places or containers.

BRIEF DESCRIPTION OF THE PRIOR ART

In the Grady Watts, U.S. Pat. No. 3,281,269, the present inventor has shown how the interior of a tank is cleaned or brightened using a sonic or ultrasonic spray generator of the type described in the yellot-Savory U.S. Pat. No. 2,519,619. In the Grady Watts U.S. Pat. No. 3,401,060 a sonic spray generator has been attached to a rotating means to cause the spray generator to completely spray the inside of a tank.

SUMMARY OF THE INVENTION

Generally speaking, the present invention contemplates an apparatus for cleaning tanks comprising in combination a rectangular box like frame having front, rear and longitudinal sides defined therein; a plurality of inlet ports at said rear, which are color coded for particular liquids, a plurality of outlet ports similarly coded and similarly aligned at said rear, valves at each of said inlet and outlet ports; a first trunk line connected and fed by all of said valves, a pump fed by said first trunk line; an output line fed by said pump, a sonic or ultrasonic spray nozzle assembly at the end of said output line; a return port in said frame, a return pump connected to said return port and a return trunk line fed by said return pump; and, a plurality of return lines connected to said outlet ports with a valve for each line, said valves all connecting to said return trunk line, said return lines feeding waste liquids from said return trunk lines to said outlet ports.

The invention as well as other objects and advantages thereof will be more clearly understood from the following detailed description when considered with the accompanying drawings in which:

FIG. 1 is a schematic explanation of the inventive concept;

FIG. 1*a* is a view from the rear of the apparatus which is the inlet and outlet side showing many of the components depicted in FIG. 1;

DETAILED DESCRIPTION

Figure 1:
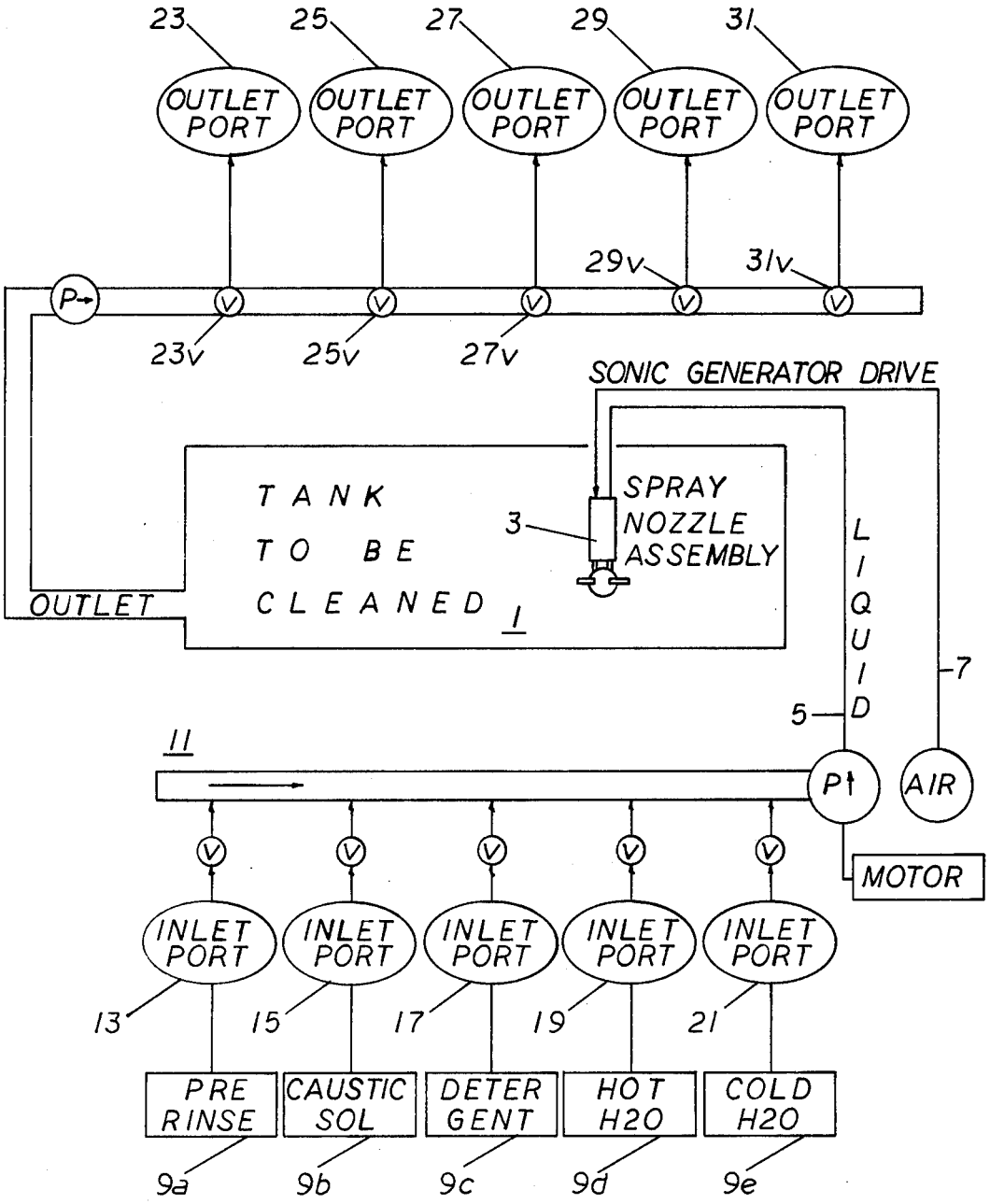

General outline of the system:

The apparatus herein contemplated is designed to clean a tank 1 using a sonic or ultrasonic spray nozzle assembly 3 which is inserted into the tank 1 through an aperture at the top of the tank as shown in FIG. 1. Various liquids are fed to the spray nozzle assembly 3 across a liquid feed line 5 and using sonic air drive 7. The various liquids used for cleaning will come from containers or drums 9a, 9b, 9c, 9d, 9e (including cold water).

Figure 1A:
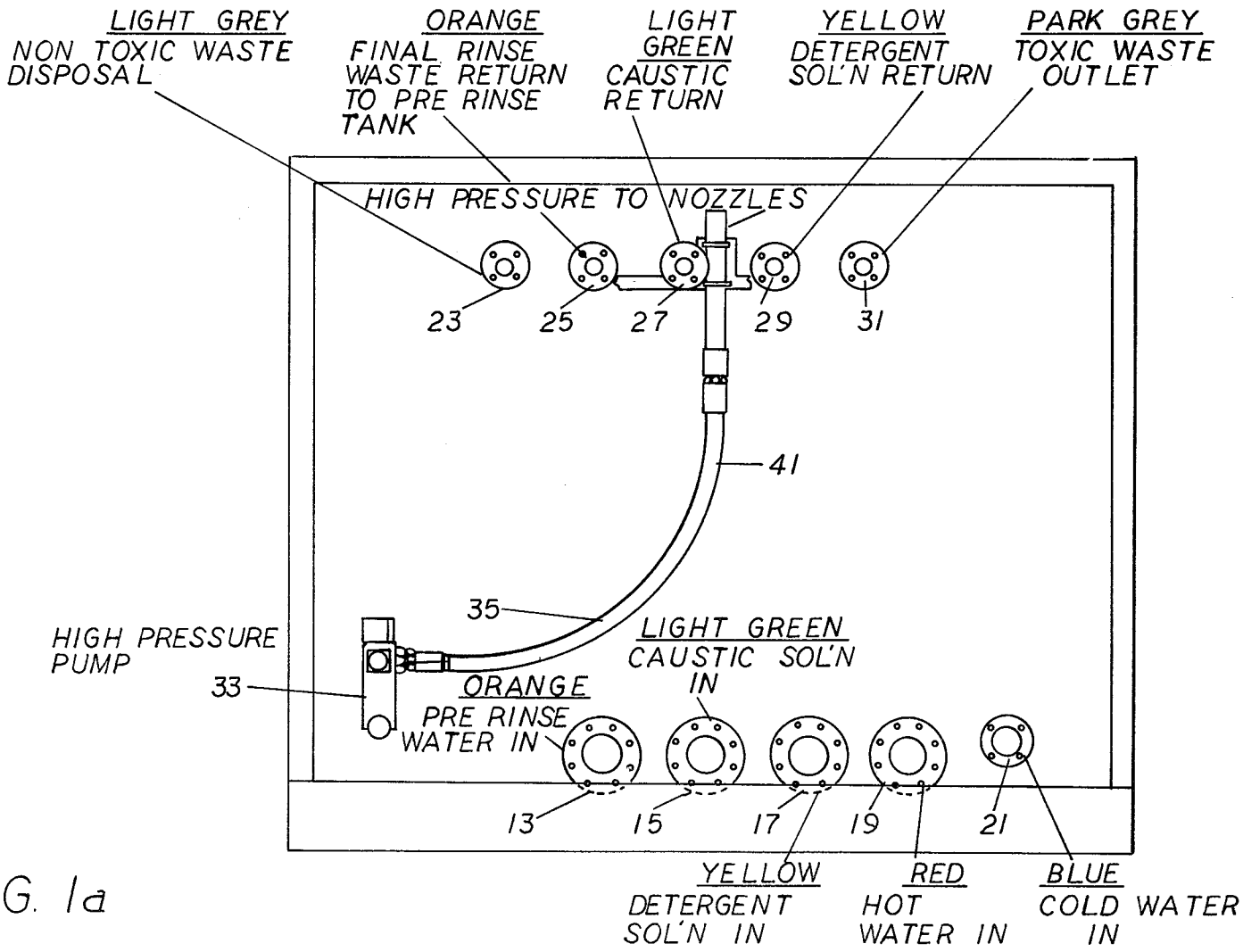
Figure 2:
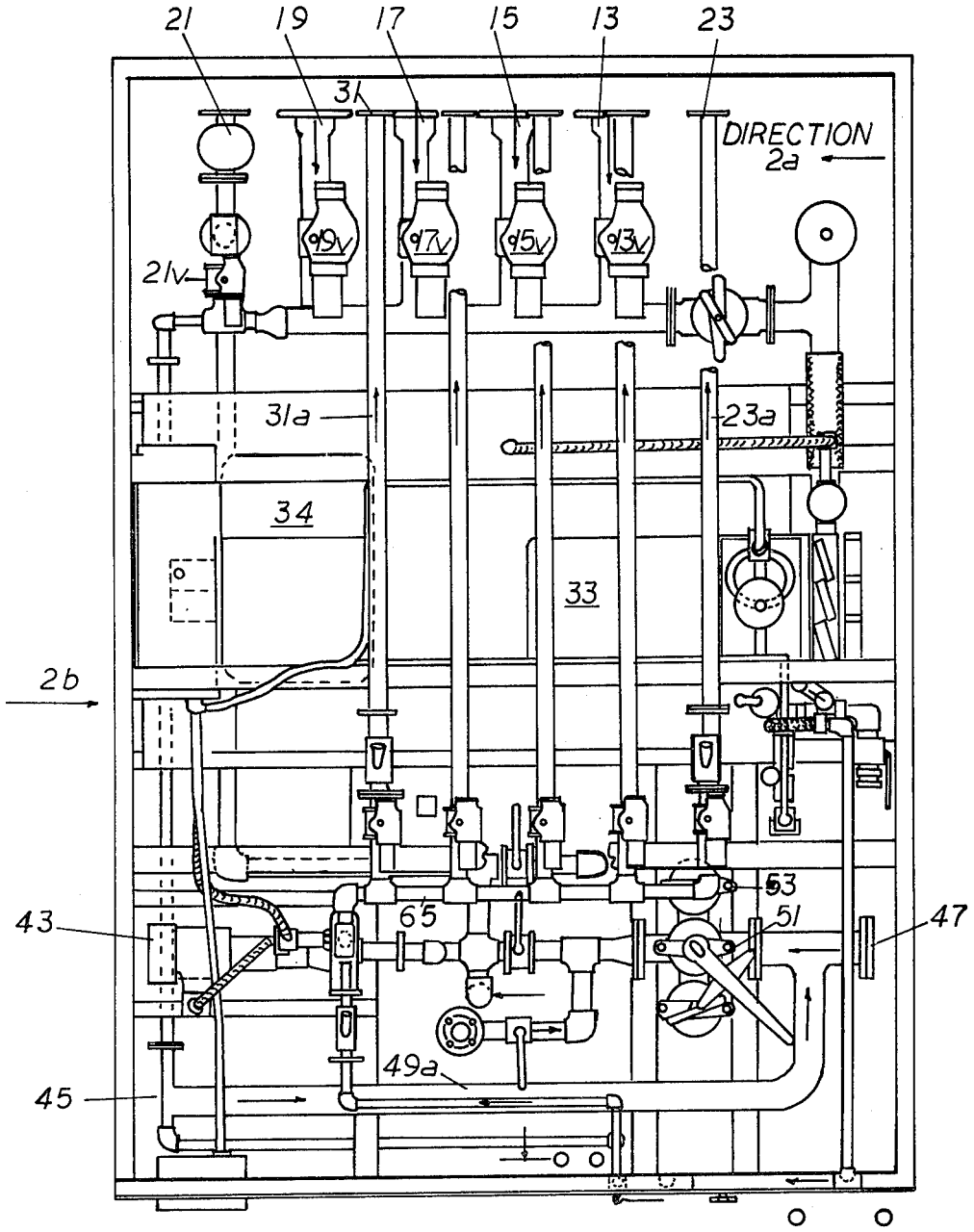
FIG. 2 is a longitudinal view looking down on the top of the apparatus.
Figure 3:
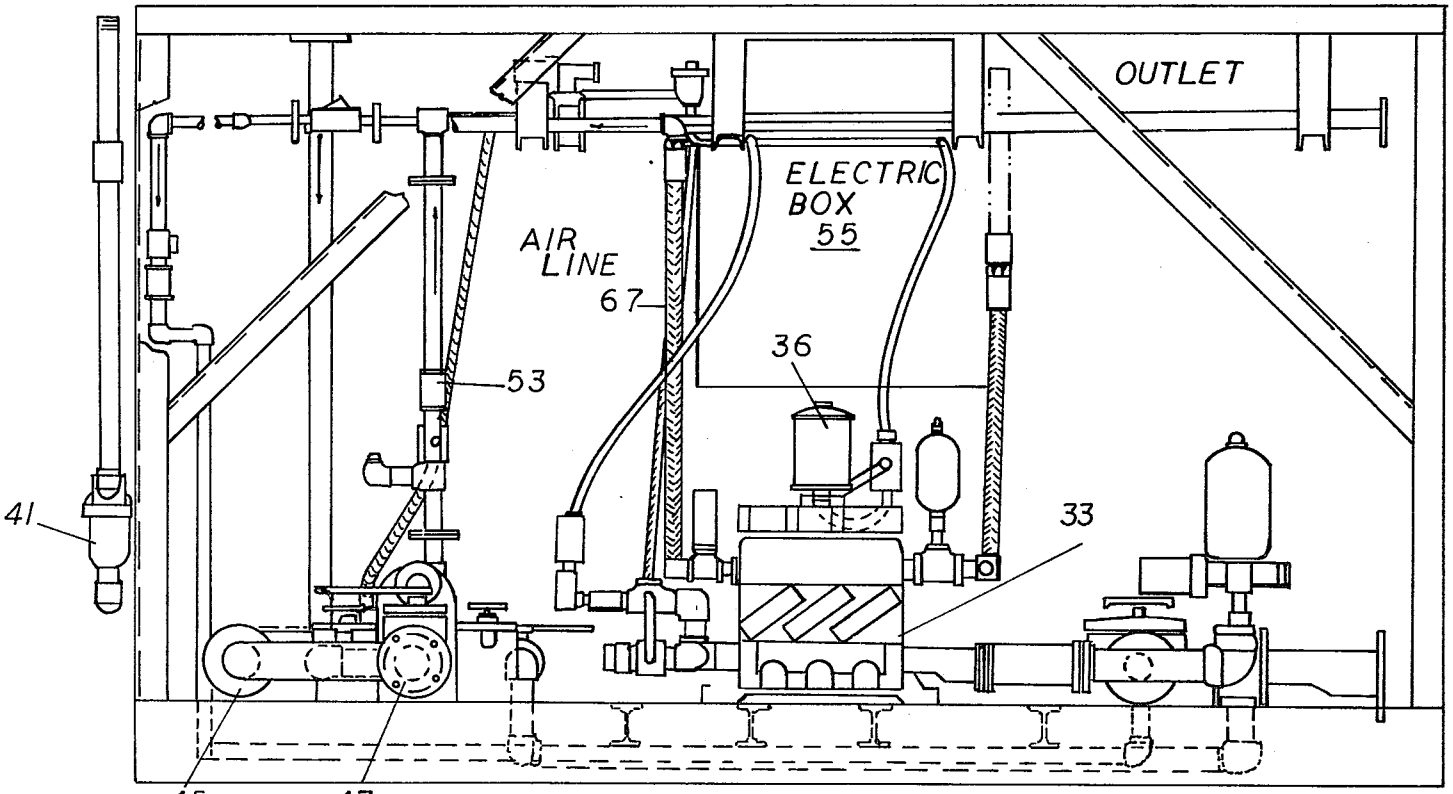
FIG. 3 is a longitudinal side elevational view in the direction 2A of FIG. 2.

The liquids in containers 9a through 9e are fed to the rear of the apparatus 11 which has the shape of a rectangular frame having inlet ports 13, 15, 17, 19, 21 at the bottom and outlet ports 23, 25, 27, 29, 31 at the top. Also seen in FIG. 1A is the high pressure pump 33 and the high pressure hose 35 to the nozzles. Looking at FIG. 2, it is seen that the inlet ports are controlled by input valves, respectively numbered 13V, 15V, 17V, 19V, 21V to correspond to the ports of the like numbers. All the inlet ports lead to a first trunk line having a main valve feeding into a high pressure pump 33. The high pressure pump 33 in turn feeds the liquid from the first trunk line 37 to the high pressure line 35 which in turn is connected to the sonic generator spray nozzles 39 and 41. The sonic generator spray nozzles are part of the nozzle assembly and spray liquid to the tank to be cleaned and, the liquid is then pumped out of the tank by the return pump 43 which pumps the liquid to the return ports 45, 47 shown in FIG. 2 and FIG. 3. These are located at the sides of the apparatus (one on each side) towards the front. Both of these return inlets 45, 47 feed into a second trunk line which leads to a diverter 51 which has a strainer. The diverter 51 feeds a vertical pipe 53 shown in FIG. 3 which in turn feeds the outlet pipes 23a, 31a, etc. leading to outlet ports 23, 25, etc., which are located at the top rear of the apparatus. The liquid can then be either recycled to the inlet ports or be discharged at distant places over separate discharge lines as desired. Although the high pressure pump is operated by a 75 HP motor the return pump 43 uses only a 1 HP motor. The electric system for the two motors is housed in a completely enclosed electric box 55 which has a main switch. This main switch will turn off the electricity and allow the box to be opened. By the foregoing arrangement, different liquids are supplied to the spray nozzles which spray the tank to be cleaned and also any liquid can be pumped through the high pressure pump. The return pump can then pump any liquid out of the tank and can either recycle this liquid back to the inlet ports or to any other location. The valves 13V through 21V are all controlled by air actuators which are located at the front of the apparatus and the electric switches are also located at the front of the apparatus.

THE INPUT AND OUTPUT SIDES

As heretofore explained, several liquids will be pumped in sequence through the tank to be cleaned. For convenience, the following color code has been selected:

13. Orange—Prerinse water
15. Light Green—Caustic Solution
17. Yellow—Detergent
19. Red—Hot water
21. Blue—Cold water Both the inlet ports 13 to 21 are so colored as well as the respective valves 13a to 21a.

A similar color code is used for the outlet ports as follows:

23. Light grey—Non toxic waste
25. Orange—Final rinse waste
27. Light Green—Caustic solution (recirculated)
29. Yellow—Detergent solution (recirculated)
31. Dark Grey—Toxic waste

LIQUID FEED FLOW

Figure 5:
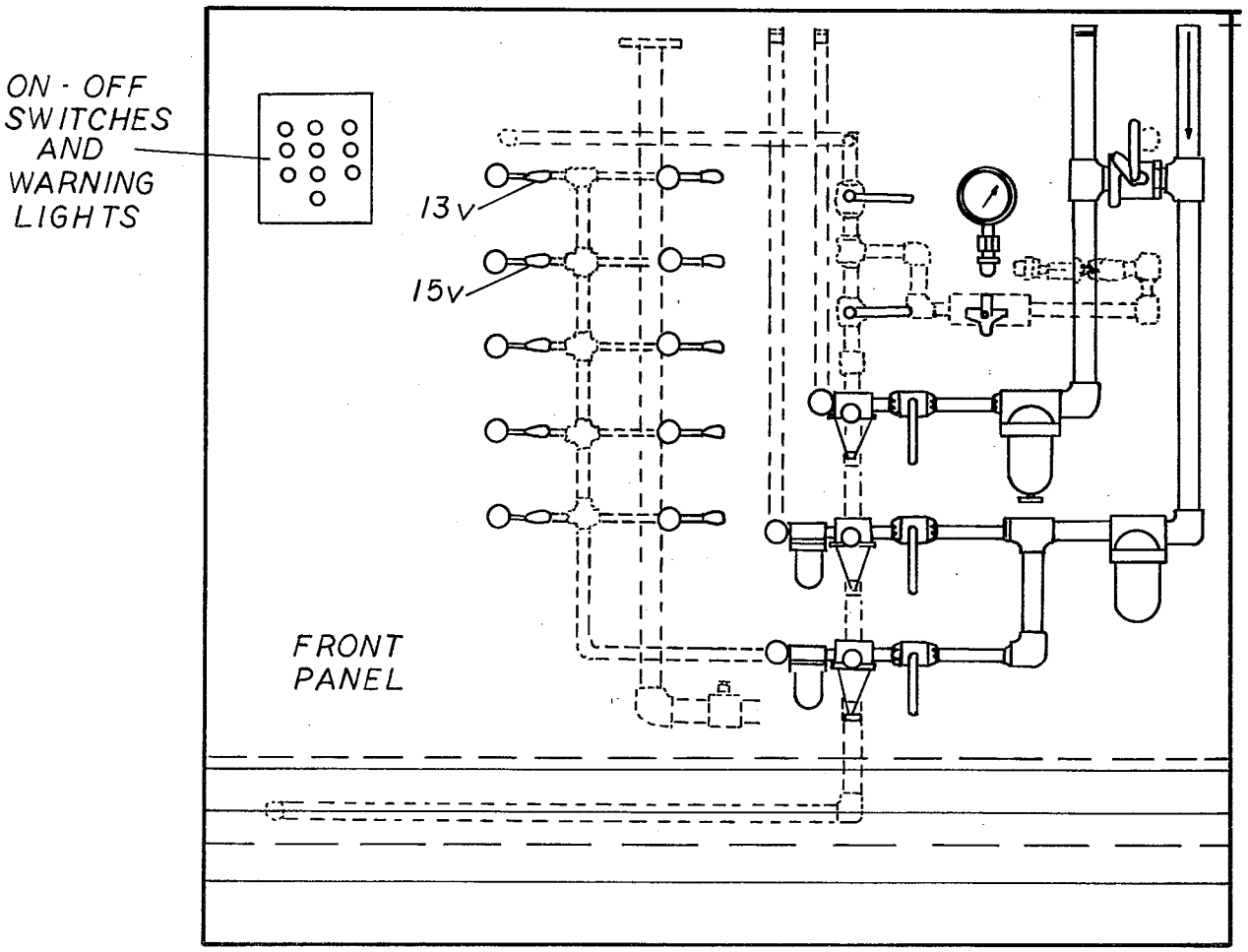
FIG. 5 shows the front of the apparatus which contains the control panel.

The various liquids to be used in the tank cleaning operation, i.e., the prerinse water, caustic solution, detergent, hot and cold water are connected to the proper inlet ports. Since various tanks require different types and treating times, the valves shown in FIG. 2, namely, 13V to 21V are hand operated from the panel shown in FIG. 5. The master valve 25 is also hand operated. These valves are all operated by pneumatic actuators. The high pressure pump 33 is started by the pump motor 34 which is also operated from the electric panel at the front of the apparatus. Pump 33 operates by means of plungers and requires an oil reservoir 36. The pump 33 pumps the one liquid selected through the high pressure hose to the sonic generator nozzle.

THE CLEANING OPERATION

Figure 4:
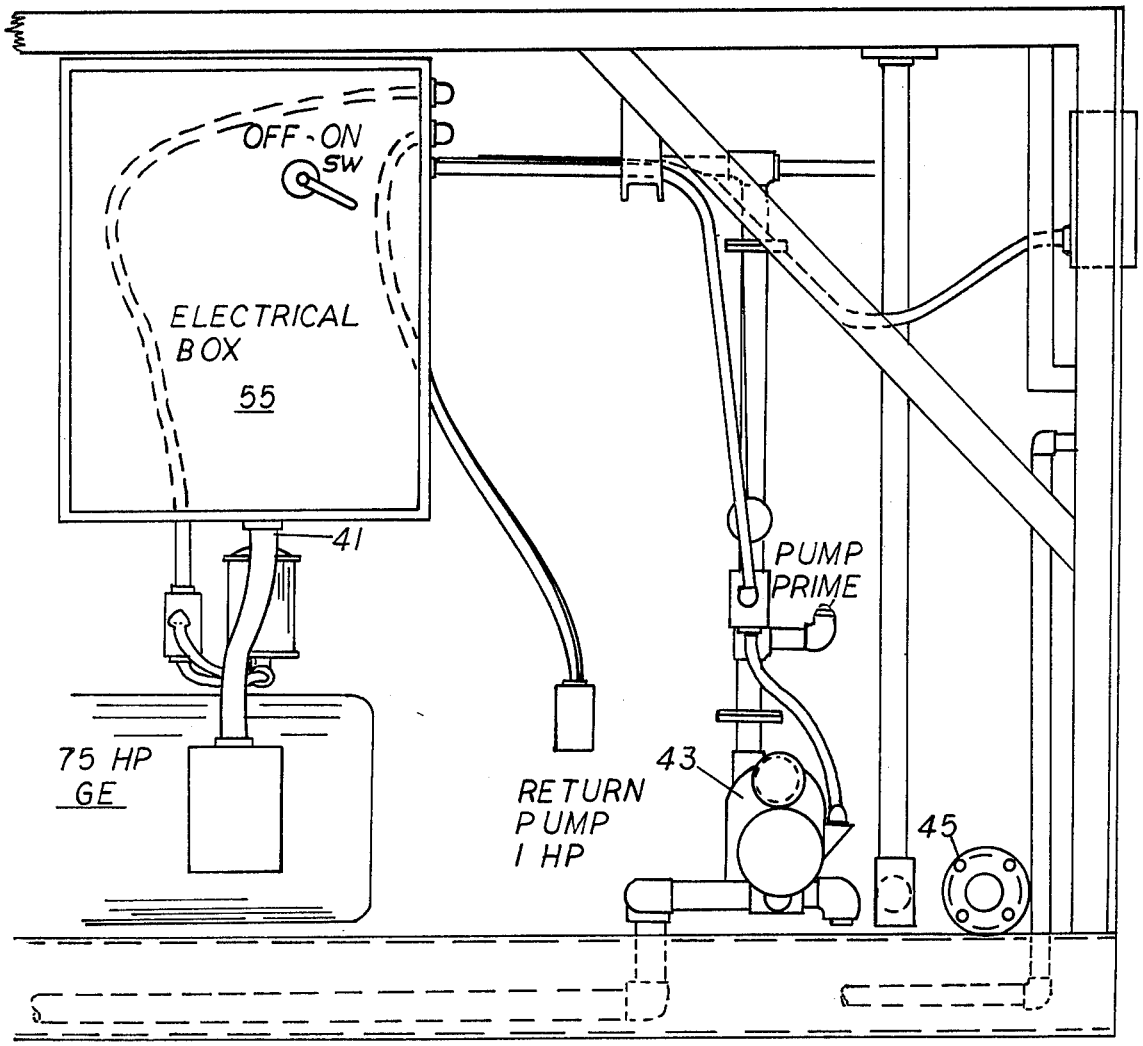
FIG. 4 shows a partial side view in the direction 2B of FIG. 2.
Figure 6:
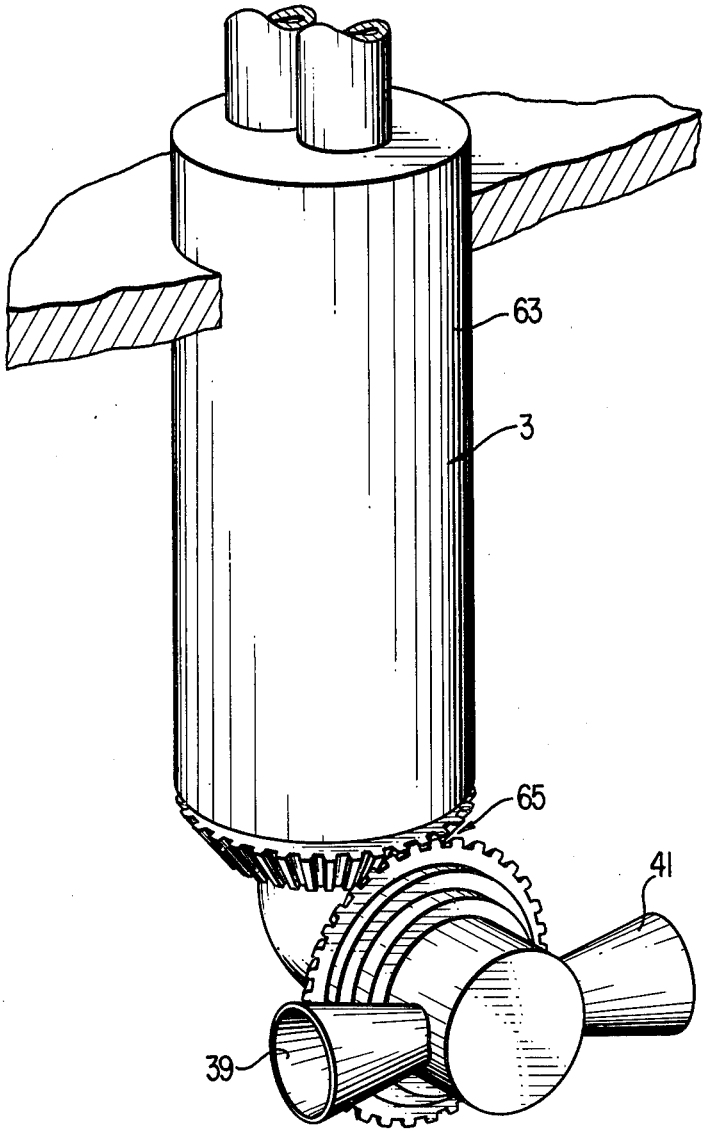
FIG. 6 illustrates the use of a double spray generator nozzle arrangement found particularly useful herein.

The sonic generator spray nozzle is of the type described in U.S. Pat. No. 3,401,060. However, two spray nozzles are used. The sonic generator spray assembly 3 has a cylindrical casing 63 shown in FIG. 6. The drive arrangement is similar to that described in U.S. Pat. No. 3,401,060 which drives a gearing arrangement shown in FIG. 4 of the aforesaid patent which will cause the sonic spray nozzles 39, 41 to rotate in a plane slightly inclined to the vertical so as to cover the entire interior of the tank to be cleaned.

THE RETURN FLOW

Liquid from the treated tank is pumped out of the tank outlet by a one HP pump 43 entering either port 45 or 47. The one HP pump 43 directs the liquid upwards along vertical pipe 53 to a third trunk line 65 which is connected to outlet ports 23a to 31a. Each outlet port 23a to 31a has a valve 23V to 31V near the third trunk line 65. The outlet ports 23a to 31a can be connected to the inlet ports 13 to 21 or can be used to carry the outflowing liquid to waste disposal systems.

THE AIR FEED AND THE POWER

The sonic generator spray nozzles herein described are operated by air pressure. The high pressure pump 33 also provides air pressure to operate the spray nozzles. The main power is supplied by a 75 HP motor 34 which is controlled by the front panel. All electric circuits are in a closed electric box 55.

The foregoing arrangement is designed to perform all phases of closed vessel cleaning, the system has eight separate capabilities:

I. Sonic presolve (vapor form) cleaning of solvent soluble soils;
II. High pressure hot alkaline secondary wash;
III. Final hot or cold rinse;
IV. Drying;
V. Brightening;
VI. Descaling;
VII. Passivation;
VIII. Deodorizing.

The sonic or ultrasonic spray nozzle captures and concentrates powerful ultrasonic shock waves which have the ability to shatter liquids into millions of fine droplets. These particles which are radiated forth from the generator rapidly disperse in a fine suspended fog with inherent fine cleaning properties. These particles 10 micron size are small enough to be excited by the rapidly fluctuating waves of pressure and dilation much like the ripples in a pool. These vibrations are at the rate of 20,000 times per second and the accelerated particles impinge upon every exposed surface reached by the sound waves.

When the proper cleaning solvents are subjected to this molecular excitation, a relatively small amount can be used.

To start a tank cleaning cycle, the proper chemical solvent is pumped through the sonic generator which has twin nozzles rotating in horizontal and vertical planes. The vapor cleaning phase, with sound waves, uses only two to three gallons of liquid cleaner which is expended.

The solvent is drawn directly from the shipping container and pumped at pressures up to 40 PSI through the nozzles on the sonic generator. These nozzles are ⅛ inch diameter. The sonic generator has a flow rate of about 15 gallons per minute.

After the pre-solve phase, which lasts only a few minutes, the detergent solution is next pumped through the sonic generator. There are two solution tanks, one is for a caustic cleaning solution and the other holds a noncaustic solution. From the tanks, the solution goes to a high pressure pump which is driven by an electric motor. The high pressure pump combined with overriding sonic air, produces the water blast phase for the secondary alkaline wash at pump pressures of 2500 PSI.

The system also returns solutions from a tank truck's drains to the tanks for recirculation if desired.

The apparatus described herein is rather large providing five inlet and outlet ports. A smaller and more compact arrangement can also be provided by reducing the number of ports. Usually the user will supply the tanks containing the various cleaning solutions. However, these tanks or containers can also be made part of the device. Naturally, wheels can be added to make the system a completely mobile system.

I claim:

1. In the cleaning of tanks by inserting a spray nozzle assembly (3) through an aperture in the top of the tank and feeding cleaning liquids to the spray nozzle assembly, which liquids are sprayed into the tank, an apparatus having a compact spray nozzle feed arrangement for feeding different liquids to said spray nozzle assembly and means for removing liquids from the tank, comprising, in combination:

(a) a rectangular box-like frame having a top, bottom, front, rear and longitudinal sides defined therein;

(b) a plurality of inlet ports (13–21) connectable to a plurality of sources of different cleaning liquids and a corresponding number of outlet ports (23–31) at said rear, said inlet ports being aligned towards said bottom and said outlet ports being aligned towards said top, each port being color coded to signify a liquid and, air actuated valves for controlling each of said ports;

(c) a first trunk line (37) towards said rear extending from about one longitudinal side to the other longitudinal side fed by all inlet port valves, a pump (33) fed by said first trunk line for pumping liquid to a high pressure line (35) which feeds the liquid to a spray nozzle of the spray nozzle assembly;

(d) a return port (47) in one of said frame longitudinal sides near the front, a return pump (43) having an inlet connectable to the tank being cleaned and an outlet connected to said return port to feed liquid removed from the tank to said return port, and, a return trunk line (49) connected to said return port;

(e) a diverter (51) coupled to said return trunk line (49) including strain means therein for filtering returned liquid, a plurality of outlet lines **(23*a*–31*a*)** coupled to said diverter, said outlet lines being in turn connected to said outlet port valves thereby feeding returned liquid to said outlet ports; and, (f) a front panel at said front including pneumatic actuator means connected to said valves for controlling connection of a selected one of said inlet ports to said first trunk line and a selected one of said outlet ports to said return trunk line.

2. The apparatus according to claim 2 further comprising means for selectively connecting a predetermined number of said outlet ports to said inlet ports.

3. An apparatus for cleaning tanks comprising, in combination:

means for defining a housing;

a plurality of inlet ports and a plurality of outlet ports positioned on the exterior of said housing, said inlet ports being connectable to a plurality of means for supplying cleaning liquids;

valve means for controlling the opening and closing of said inlet and said outlet ports;

a first trunk line inside said housing connected to and fed by said inlet ports;

a first pump having an inlet connected to said first trunk line;

an output line fed by said first pump;

means insertable into a tank to be cleaned and connected to said output line for spraying cleaning liquids onto walls of the tank;

a return port positioned on the exterior of said housing;

a second pump having an inlet connectable to the tank being cleaned and an outlet connected to said return port;

a return trunk line inside said housing connected to said return port for receiving returned liquid;

a plurality of return lines for connecting each of said plurality of outlet ports to said return trunk line; and control means for controlling said valve means to selectively connect one of said inlet ports to said first trunk line and to selectively connect one of said outlet ports to said return trunk line.

4. The apparatus according to claim 3 further comprising means for selectively connecting one of said plurality of outlet ports to one of said plurality of inlet ports thereby recycling cleaning liquid.

* * * * *